US008185008B2

(12) United States Patent
Sato

(10) Patent No.: US 8,185,008 B2
(45) Date of Patent: May 22, 2012

(54) FIXING DEVICE AND IMAGE FORMING APPARATUS WITH A TEMPERATURE DETECTOR

(75) Inventor: Toshiki Sato, Tokyo (JP)

(73) Assignee: Oki Data Corporation, Tokyo (JP)

( * ) Notice: Subject to any disclaimer, the term of this patent is extended or adjusted under 35 U.S.C. 154(b) by 265 days.

(21) Appl. No.: 12/591,637

(22) Filed: Nov. 25, 2009

(65) Prior Publication Data

US 2010/0142987 A1 Jun. 10, 2010

(30) Foreign Application Priority Data

Dec. 8, 2008 (JP) ..... 2008-312673

(51) Int. Cl.
*G03G 15/20* (2006.01)
*G03G 15/16* (2006.01)

(52) U.S. Cl. ..... 399/69; 399/33; 399/122; 399/329

(58) Field of Classification Search ..... 399/33, 399/67, 69, 122, 329
See application file for complete search history.

(56) References Cited

U.S. PATENT DOCUMENTS 5,907,348 A * 5/1999 Ogasawara et al. ..... 347/212
2006/0083529 A1* 4/2006 Akizuki et al. ..... 399/69
2006/0269308 A1* 11/2006 Ishii ..... 399/69

FOREIGN PATENT DOCUMENTS

JP 2005-134646 A 5/2005

* cited by examiner

*Primary Examiner* — David Gray
*Assistant Examiner* — Joseph S Wong
(74) *Attorney, Agent, or Firm* — Rabin & Berdo, P.C.

(57) ABSTRACT

A fixing device includes a heater, first and second pressure-applying members, a belt support member, a fixing belt, a contact member and a temperature detector. The fixing belt is entrained about the heater, the first pressure-applying member and the belt support member. The second pressure-applying member opposes the first pressure-applying member through the fixing belt. The contact member, which extends in the width direction of the fixing belt, is in contact with an inner surface of the fixing belt. The temperature detector, which is disposed between the belt support member and the contact member, detects a temperature of the fixing belt through the contact member.

10 Claims, 13 Drawing Sheets

FIXING DEVICE AND IMAGE FORMING APPARATUS WITH A TEMPERATURE DETECTOR

CROSS-REFERENCE TO RELATED APPLICATION

This application claims priority based on 35 USC 119 from prior Japanese Patent Application No. P 2008-312673 filed on Dec. 8, 2008, the entire contents of which are incorporated herein by reference.

BACKGROUND OF THE INVENTION

1. Field of the Invention

This application relates to a fixing device that fixes a toner image onto a recording medium with heat and pressure. The application also relates to an image forming apparatus that includes the fixing device and prints an image in accordance with image data from an external device.

2. Description of the Related Art

An image forming apparatus, such as a printer, a copier, a facsimile machine or an electrophotographic color recorder, transfers a toner image corresponding to image data to a recording medium and fixes the toner image onto the recording medium with heat and pressure by a fixing device.

The fixing device includes a heat roller, an upper pressure roller, a lower pressure roller, a fixing belt, a temperature detector and a heater. The fixing belt is entrained about the heat roller and the upper pressure roller, and is heated by the heat roller. The temperature detector detects a temperature of the fixing belt at the portion that comes into contact with the heat roller. The image forming apparatus controls the heater based on the temperature detected by the temperature detector so as to keep the temperature of the heat roller constant.

In the fixing device, while the lower pressure roller is in pressure contact with the upper roller through the fixing belt, the recording medium with the toner image is advanced between the fixing belt and the lower pressure roller. As a result, the toner image, which adheres to a surface of the recording medium with mild static electricity, is fused on the recording medium with heat from the fixing belt and pressure from the lower pressure roller. Japanese Patent Laid-Open No. 2005-134646 discloses one such fixing device.

In the aforementioned fixing device, however, the temperature detector is provided in abutting contact with a surface of the fixing belt with which the recording medium comes into contact. Therefore, the surface of the fixing belt is liable to form scratches in which toner will become concentrated. This will cause adverse effects on print quality.

Meanwhile, a fixing device in which the temperature detector is provided in abutting contact with an inner surface of the fixing belt is also well known. In the fixing device, however, the fixing belt is liable to wear nonuniformly by friction between the temperature detector and the fixing belt, thereby causing variations in temperature of the fixing belt in its width direction. This also will cause adverse effects on print quality.

SUMMARY OF THE INVENTION

An object of the application is to disclose a fixing device and an image forming apparatus capable of preventing scratches on a surface of a fixing belt, and capable of preventing temperature variations of the fixing belt even when the fixing belt wears.

A fixing device includes a heater, first and second pressure-applying members, a belt support member, a fixing belt, a contact member and a temperature detector. The fixing belt is entrained about the heater, the first pressure-applying member and the belt support member. The second pressure-applying member opposes the first pressure-applying member through the fixing belt. The contact member, which extends in the width direction of the fixing belt, is in contact with an inner surface of the fixing belt. The temperature detector, which is disposed between the belt support member and the contact member, detects the temperature of the fixing belt through the contact member.

In another aspect, a fixing device includes a heater, first and second pressure-applying members, a belt support member, a fixing belt and a temperature detector. The fixing belt is entrained about the heater, the first pressure-applying member and the belt support member. The second pressure-applying member opposes the first pressure-applying member through the fixing belt. The temperature detector detects the temperature of the fixing belt. The belt support member has a recess on a surface thereof that comes into contact with the fixing belt. The temperature detector is disposed in the recess apart from the fixing belt.

In still another aspect, an image forming apparatus includes a transport unit that transports a recording medium, an image forming unit that forms a toner image on a surface of the recording medium, and the fixing device that fixes the toner image formed by the image forming unit onto the recording medium.

The full scope of applicability of the fixing device and the image forming apparatus will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The fixing device and the image forming apparatus will become more fully understood from the detailed description given herein and the accompanying drawings, which are given by way of illustration only, and thus do not limit the invention, and wherein.

DETAILED DESCRIPTION OF THE INVENTION

Preferred embodiments of a fixing device and an image forming apparatus according to the invention will be described in detail with reference to the accompanying drawings. In each embodiment, the description will be given with an electrophotographic monochrome printer as an image forming apparatus.

First Embodiment

Figure 1:
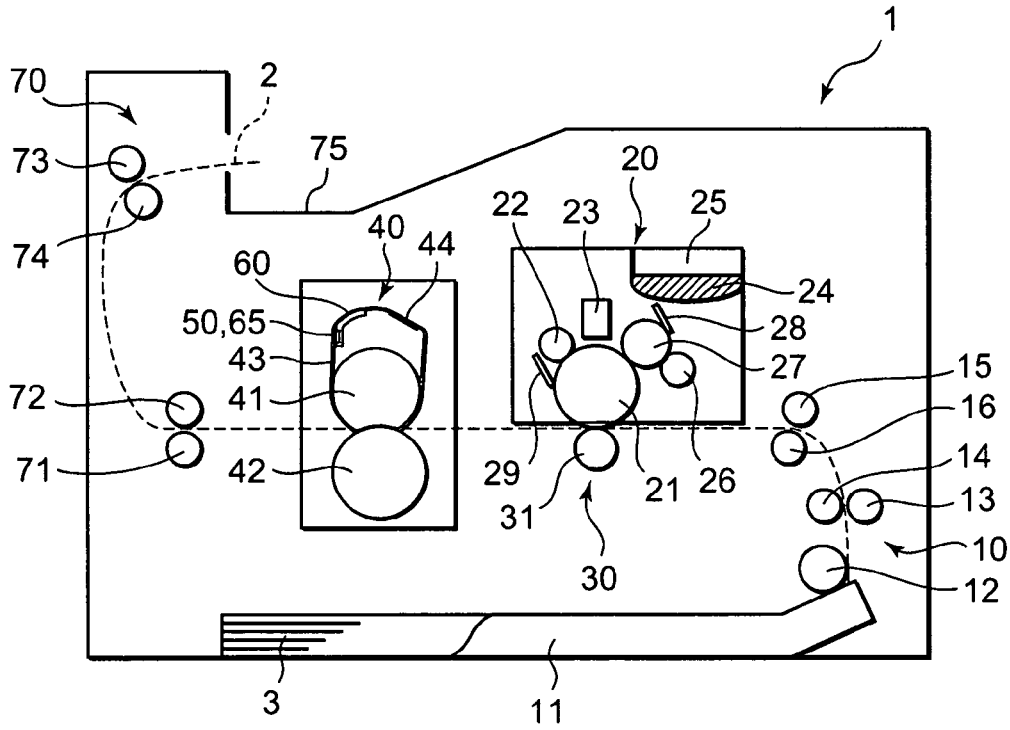
FIG. 1 is a schematic view of a printer of a first embodiment.

FIG. 1 is a schematic view of a printer 1 according to a first embodiment, which may include a sheet transport unit 10, a toner image forming unit 20, a transfer unit 30, a fixing unit 40 and a discharge unit 70. The sheet transport unit 10 picks up a recording medium 3 such as a sheet of paper from a sheet cassette 11 and transports the recording medium 3 toward the toner image forming unit 20 and the transfer unit 30. The toner image forming unit 20 forms a toner image in accordance with image data from an external device. The transfer unit 30 transfers the toner image formed by the toner image forming unit 20 to the recording medium 3. The fixing unit 40 fixes the toner image transferred to the recording medium 3 by the transfer unit 30, onto the recording medium 3 with heat and pressure. The discharge unit 70 delivers the recording medium 3 having the fixed toner image thereon to a stacker 75. Note that the toner image forming unit 20 serves as an image forming unit, together with the transfer unit 30. A transport path 2 is a path through which the recording medium 3 is transported to the sheet transport unit 10, the toner image forming unit 20, the transfer unit 30, the fixing unit 40 and the discharge unit 70. The transport path 2 may be substantially S-shaped. Each of the above-mentioned elements, which are provided along the transport path 2, will be described in more detail below.

Under the control of a print controller 4, described later, the sheet transport unit 10 picks up the recording medium 3 from the sheet cassette 11 and transports the recording medium 3 toward the toner image forming unit 20 and the transfer unit 30, at timing of forming the toner image in the toner image forming unit 20. Referring to FIG. 1, the sheet transport unit 10 may include the sheet cassette 11, a hopping roller 12, a pressure roller 13, a registration roller 14, a pressure roller 15 and a registration roller 16.

The sheet cassette 11 accommodates a stack of recording media 3 and is detachably mounted to the printer 1. The recording medium 3 accommodated in the sheet cassette 11 is a recording sheet of predetermined size for printing monochrome image data or color image data. The recording medium 3 may be a sheet of plain paper, recycled paper, gloss paper or high-quality paper, plastic sheet or viewgraph (sheet for OHP (Overhead Projector)). While pressing the stack of recording media accommodated in the sheet cassette 11, the hopping roller 12 rotates to pick up each recording medium 3 one-by-one from the sheet cassette 11. Then, the hopping roller 12 feeds the recording medium 3 to the pressure roller 13 and the registration roller 14. The pressure roller 13 and the registration roller 14 are provided in opposition to each other so as to sandwich the recording medium 3 therebetween. The registration roller 14 rotates under pressure from the pressure roller 13 so as to transport the recording medium 3 to the pressure roller 15 and the registration roller 16 while correcting skew of the recording medium 3. The pressure roller 15 and the registration roller 16 are provided in opposition to each other so as to sandwich the recording medium 3 therebetween. The registration roller 16 rotates under pressure from the pressure roller 15 so as to transport the recording medium 3 to the toner image forming unit 20 and the transfer unit 30 while correcting skew of the recording medium 3.

The toner image forming unit 20 forms a toner image in accordance with image data from an external device. The toner image forming unit 20 is detachably mounted to the printer 1. Referring to FIG. 1, the toner image forming unit 20 may include a cylindrical rotatable photosensitive drum 21, a charging roller 22, an LED (light-emitting diode) head 23, a toner cartridge 25, a toner supply roller 26, a developing roller 27, a developing blade 28 and a cleaning blade 29.

The photosensitive drum 21, or other image bearing body, forms the toner image as a developer image thereon. The photosensitive drum 21 is capable of storing electrical charge on its outer surface to bear an electrostatic latent image corresponding to the image data. The photosensitive drum 21 may be composed of a conductive body made of aluminum or the like, coated by a photosensitive layer. The photosensitive layer may include a photoconductive layer and a charge transport layer.

The charging roller 22 is connected to an electric power supply, not shown, and applies a predetermined positive voltage or negative voltage to the surface of the photosensitive drum 21, thereby charging the drum surface uniformly. The charging roller 22 is rotatable while in contact with the drum surface under a constant pressure. The charging roller 22 may be composed of a conductive metallic shaft coated with semiconductive rubber. The semiconductive rubber is silicone or the like.

The LED head 23, or an exposure unit, exposes the surface of the photosensitive drum 21 in accordance with the image data to form the electrostatic latent image on the surface. In this embodiment, the LED head 23 is provided above the photosensitive drum 21. The LED head 23 may include LED elements, a lens array and LED drive elements.

The toner cartridge 25, which stores toner 24 therein, is mounted to the toner image forming unit 20 so as to locate above the toner supply roller 26. The toner cartridge 25 may be substantially rectangular, but has a curved surface at the bottom thereof and extends in a direction perpendicular to the transport direction of the recording medium 3. The toner cartridge 25 is detachably mountable to toner image forming unit 20 for easy replacement.

The toner supply roller 26 rotates while in contact with the developing roller 27, thereby supplying the developing roller 27 with the toner 24. The toner supply roller 26 may be composed of a rubber-coated conductive metallic shaft. The rubber may contain blowing agents.

The developing roller 27 is rotatable while in contact with the surface of the photosensitive drum 21 at a constant pressure. The developing roller 27 carries the toner 24 to the photosensitive drum 21, thereby developing the electrostatic latent image formed on the surface of the photosensitive drum 21 by the toner 24. The developing roller 27 may be composed of a conductive metallic shaft coated with semiconductive urethane rubber.

The developing blade 28, whose one end abuts a surface of the developing roller 27, scrapes excessive toner 24 off the surface of the developing roller 27, thereby forming a toner layer that is uniform in thickness on the surface. The developing blade 28 is in the form of a plate and may be made of stainless steel.

The cleaning blade 29 is in the form of a plate and may be made of rubber. One end of the cleaning blade 29 abuts the surface of the photosensitive drum 21 to remove residual toner 24 remaining on the surface of the photosensitive drum 21 after transferring most of the toner image on the photosensitive drum 21 to the recording medium 3.

The transfer unit 30 transfers the toner image formed by the toner image forming unit 20 to the recording medium 3. As shown in FIG. 1, the transfer unit 30 includes a transfer roller 31 that faces the photosensitive drum 21. The transfer roller 31 is rotatable while in contact with the surface of the photosensitive drum 21, so as to advance the recording medium 3 between them. The transfer roller 31 is supplied with a bias voltage that has a reverse polarity relative to a charging polarity of the toner 24 to transfer the toner image on the surface of the photosensitive drum 21 to the recording medium 3.

The fixing unit 40 fixes the toner image transferred to the recording medium 3 by the transfer unit 30, onto the recording medium 3 with heat and pressure. Referring to FIG. 1, the fixing unit 40 includes an upper pressure roller 41 as a first pressure-applying member, a lower pressure roller 42 as a second pressure-applying member, an endless fixing belt 43, a heater 44, a belt thermistor unit 50, a belt support member 60 and a contact member 65. The fixing unit 40 will be described in more detail with reference to FIGS. 2 to 5.

Figure 2:
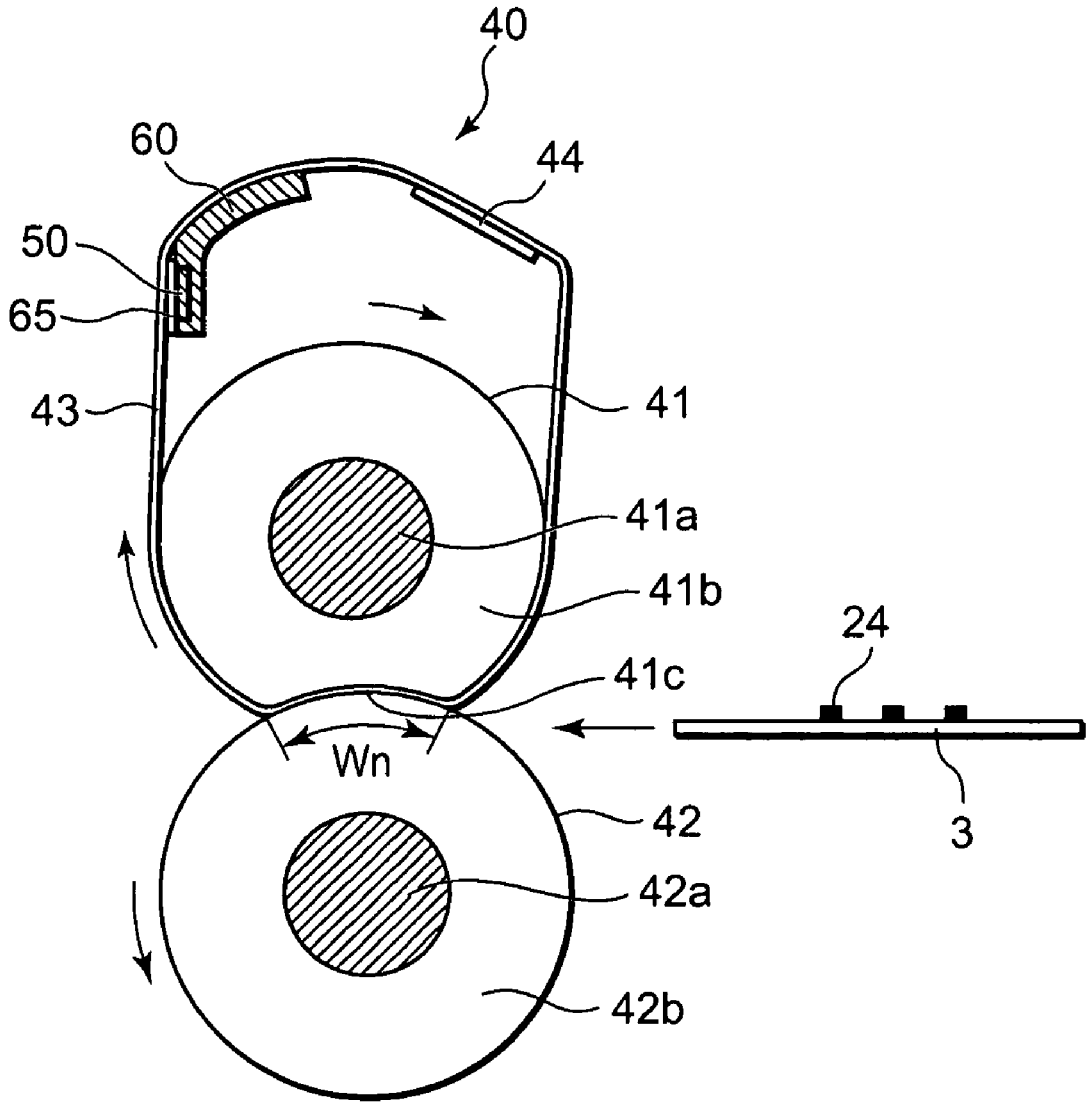
FIG. 2 is a sectional side view of a fixing unit of the first embodiment.
Figure 3:
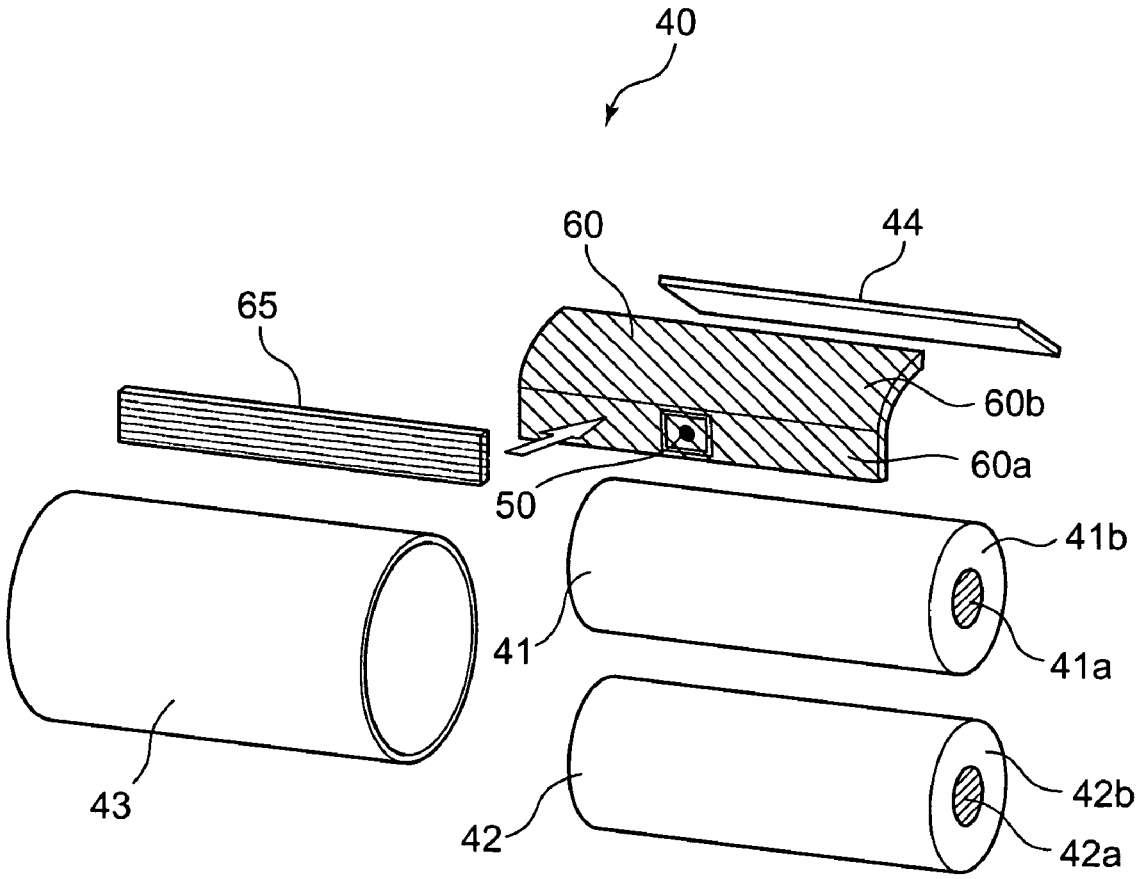
FIG. 3 is an exploded perspective view of the fixing unit of the first embodiment.
Figure 4:
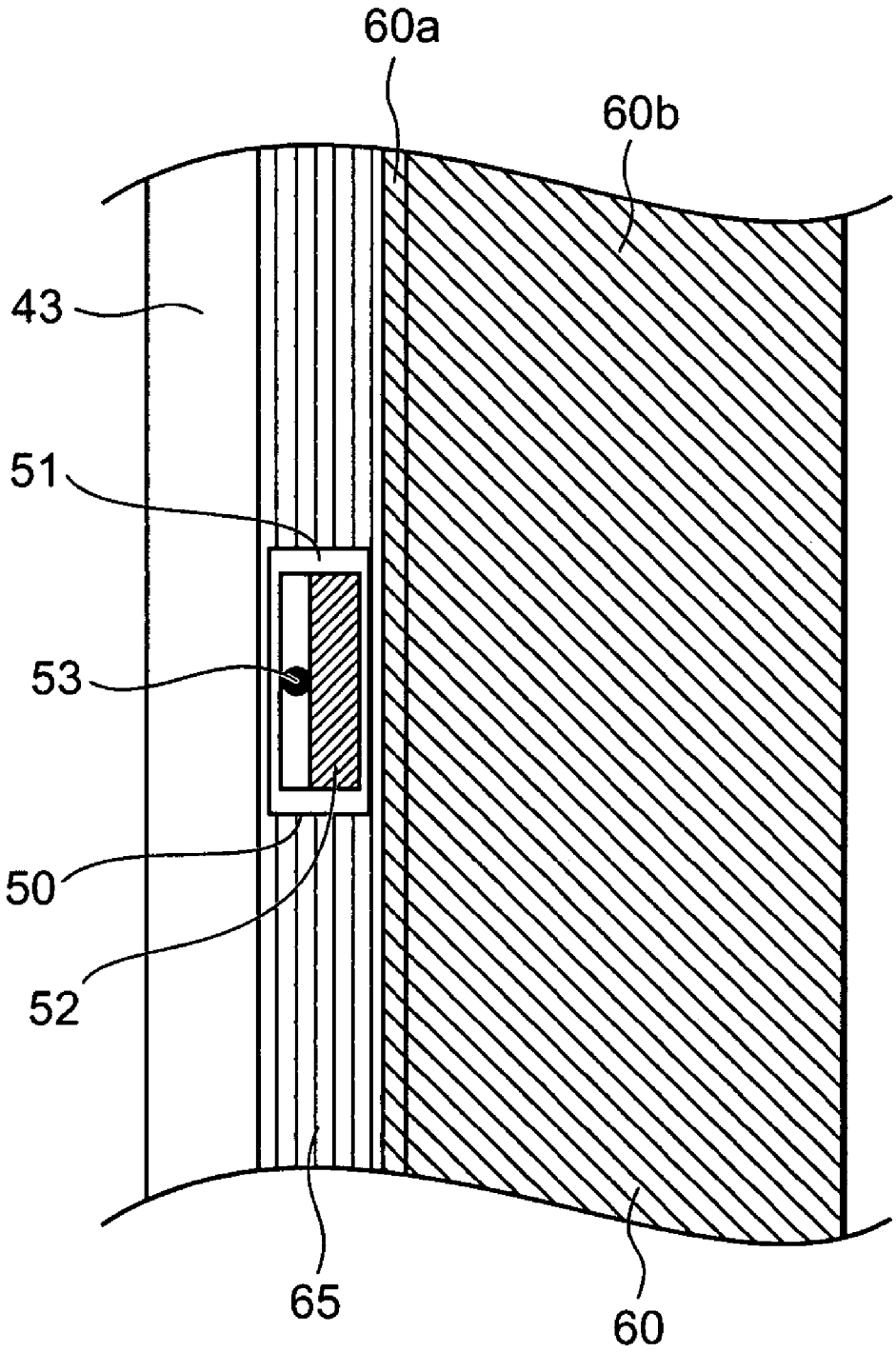
FIG. 4 a partially enlarged view of the vicinity of a belt thermistor unit of the first embodiment.
Figure 5:
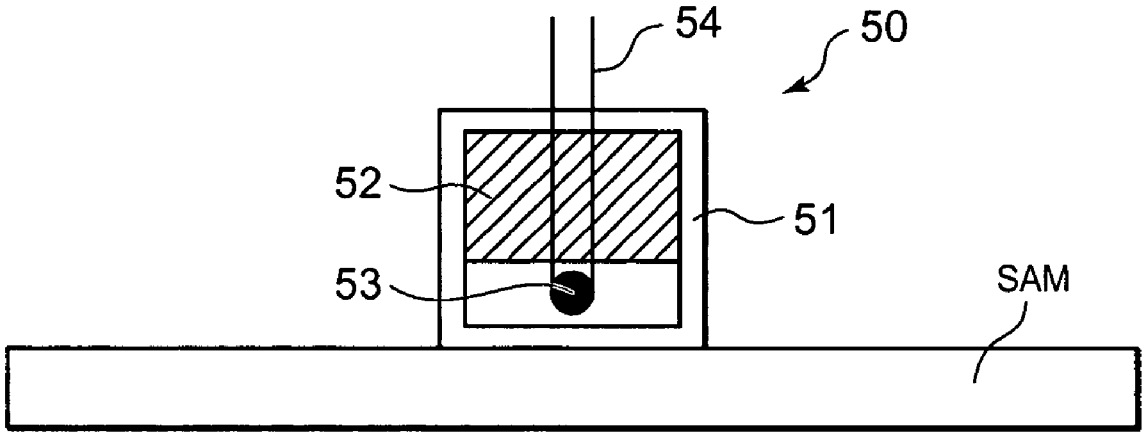
FIG. 5 is a schematic view of the belt thermistor unit of the first embodiment.

FIGS. 2 and 3 are respectively a sectional side view and an exploded perspective view of the fixing unit 40. FIG. 4 is a partially enlarged view of the vicinity of the belt thermistor unit 50. FIG. 5 is a schematic view of the belt thermistor unit 50. In FIG. 4, the contact member 65 is shown in a state where part of it has been removed for convenience of explanation.

Referring to FIG. 2, the fixing belt 43 and the lower pressure roller 42 are provided in opposition to each other to sandwich the recording medium 3 transported from the transfer unit 30 therebetween, thereby fixing the toner image, which adheres to the surface of the recording medium 3 with mild static electricity, on the recording medium 3 with heat from the fixing belt 43 and pressure from the lower pressure roller 42. The fixing belt 43 is entrained about the upper pressure roller 41, the heater 44 and the belt support member 60, and is heated by the heater 44. The lower pressure roller 42 faces the upper pressure roller 41 through the fixing belt 43. The belt thermistor unit 50 that is incorporated in the belt support member 60 detects a temperature of the fixing belt 43. The temperature control of the heater 44, which will be described later, is performed based on the temperature detected by belt thermistor unit 50.

The upper pressure roller 41 is composed of a shaft 41*a* coated by an elastic layer 41*b*. The shaft 41*a* may be made of iron and its outside diameter may be 32 mm. The elastic layer 41*b* may be made of a 4 mm-thick heat-resistant porous sponge material. The elastic layer 41*b* has low thermal conductivity and heat insulating property. Therefore, the elastic layer 41*b* absorbs very little heat from the fixing belt 43 heated by the heater 44, thereby shortening recovery time until the temperature of the fixing belt 43 reaches a predetermined fixing temperature. In addition, the hardness of the elastic layer 41*b* is low enough that the width Wn of a nip portion 41*c*, along which the recording medium 3 comes into contact with the fixing belt 43, falls within the range of 10 to 25 mm, thereby fixing the toner image onto the recording medium 3 properly. Specifically, it is preferable that an Asker C hardness of the elastic layer 41*b* is within the range of 20 to 60 for the above mentioned purpose. The upper pressure roller 41 has a gear that is connected to the sheet transport unit 10 through a driving force transmission mechanism not shown. Thus, the upper pressure roller 41 rotates in conjunction with the movement of the sheet transport unit 10.

Similarly to the upper pressure roller 41, the lower pressure roller 42 is composed of a shaft 42*a* coated by an elastic layer 42*b*. The shaft 42*a* may be made of iron and its outside diameter may be 32 mm. The elastic layer 42*b* may be made of a 4 mm-thick thermally-resistant porous sponge material. The lower pressure roller 42 faces the upper pressure roller 41 through the fixing belt 43, and is rotatable while being urged against the upper pressure roller 41 at a constant pressure by means of an urging member such as a spring not shown. Therefore, the lower pressure roller 42 is rotated by the upper pressure roller 41.

The fixing belt 43 is entrained about the upper pressure roller 41, the heater 44 and the belt support member 60, and is heated by the heater 44, thereby transporting the recording medium 3 while heating it. The fixing belt 43 may be composed of a base covered by a release layer. The base may be made of polyimide resin that has high heat-resistance and its thickness may be 100 μm. The release layer may be made of silicon rubber and its thickness may be 200 μm. The fixing belt 43 shows a fast heat response due to its low heat capacity. Note that the material of the base is not only polyimide resin but also metal, such as stainless steel and nickel, or rubber.

The heater 44 is in contact with the fixing belt 43 and heats the belt. The heater 44 may include a substantially plate-like substrate, a resistance heating element, an electrical insulating layer, electrodes and a protective layer, not shown. The substrate supports the resistance heating element, the electrical insulating layer, the electrodes and the protective layer thereon. The substrate and the protective layer may be respectively made of SUS430 stainless steel and fluorinated resin. The electrodes, not shown, are connected to an electric power supply 44*p*, as a voltage-applying unit, for the heater 44. The electric power supply 44*p* applies a voltage through the electrodes to the resistance heating element of the heater 44. The voltage applied to the resistance heating element may be 100 V and the output of the heater 44 may be 1200 W.

The belt thermistor unit 50 is incorporated in the belt support member 60 to detect the temperature of the fixing belt 43. Referring to FIG. 5, the belt thermistor unit 50 may include a thermistor 53, a fixed member 51, an adiabatic member 52 and thermistor wires 54. In this embodiment, an object SAM whose temperature should be detected is the fixing belt 43. As shown in FIG. 4, the belt thermistor unit 50 is supported at a flat portion 60*a* of the belt support member 60.

The fixed member 51 fixes the thermistor 53. The fixed member 51 is substantially box-shaped and may have a wall thickness of 50 μm. The fixed member 51 may be made of polyimide resin that has high heat-resistance. The adiabatic member 52 brings the thermistor 53 into pressure contact with the object SAM through the fixed member 51 in an adiabatic condition. The adiabatic member 52 may be made of a sponge material that has high heat-resistance to insulate the thermistor 53 from heat not originating from the fixing belt 43. Therefore, the adiabatic member 52 is capable of preventing the thermistor 53 from detecting the temperature of the fixing belt 43 improperly. The thermistor 53, or other temperature detector, detects the temperature of the fixing belt 43. Specifically, the thermistor 53 has resistance that varies depending on the temperature of the object SAM. As described later, the print controller 4 calculates the temperature of the object SAM based on the resistance of the thermistor 53, thereby detecting the temperature of the fixing belt 43. In this embodiment, the thermistor 53 has a negative temperature coefficient (NTC) and its resistance decreases with increases in temperature. The thermistor wires 54 connect the thermistor 53 and the print controller 4. One end of each of the thermistor wires 54 is connected to the thermistor 53 and the other end of each of them is connected to the print controller 4. The print controller 4 acquires the resistance of the thermistor 53 through the thermistor wires 54.

The belt support member 60 includes the flat portion 60*a* and a curved portion 60*b*, which are in contact with the fixing belt 43. The flat portion 60*a* may be substantially rectangular and may be made of polyphenylene sulfide (PPS) that has high heat-resistance. The belt thermistor unit 50 is disposed in a recess formed in the middle of the flat portion 60*a*. A surface of the curved portion 60*b* is rounded so as not to interfere with rotation of the fixing belt 43. As shown in FIG. 2, the belt support member 60 is disposed downstream of the nip portion 41*c* and upstream of the heater 44 in the direction of rotation of the fixing belt 43. The width of the belt support member 60 is greater than or equal to the width of the fixing belt 43. Therefore, the belt support member 60 comes into uniform contact with an inner surface of the fixing belt 43 throughout the entire area in the width direction of the fixing belt 43.

The contact member 65 is substantially rectangular and its thickness may be 50 μm. The contact member 65 may be made of polyimide resin that has high heat-resistance. The contact member 65 is attached to the belt support member 60 so as to cover the flat portion 60*a* in which the belt thermistor unit 50 is disposed. The width of the contact member 65 is greater than or equal to the width of the fixing belt 43. Therefore, the contact member 65 comes into uniform contact with the inner surface of the fixing belt 43 throughout the entire area in the width direction of the fixing belt 43. In this embodiment, the thermistor 53 in the belt thermistor unit 50 detects the temperature of the fixing belt 43 through the fixed member 51 and the contact member 65.

The discharge unit 70 delivers the recording medium 3 with the toner image thereon to the stacker 75. Referring to FIG. 1, the discharge unit 70 may include a transport roller 71, a roller 72, a discharge roller 73, a roller 74 and the stacker 75. The transport roller 71 and the roller 72 are provided in opposition to each other to sandwich the recording medium 3 transported from the fixing unit 40 therebetween. The roller 72 is rotated by the transport roller 71. The transport roller 71 and the roller 72 transport the recording medium 3 to the discharge roller 73 and the roller 74. The discharge roller 73 and the roller 74 are provided in opposition to each other to sandwich the recording medium 3 transported from the transport roller 71 and the roller 72 therebetween. The roller 74 is rotated by the discharge roller 73. The discharge roller 73 and the roller 74 deliver the recording medium 3 to the stacker 75 on which the recording medium 3 with the toner image thereon is held.

Figure 6:
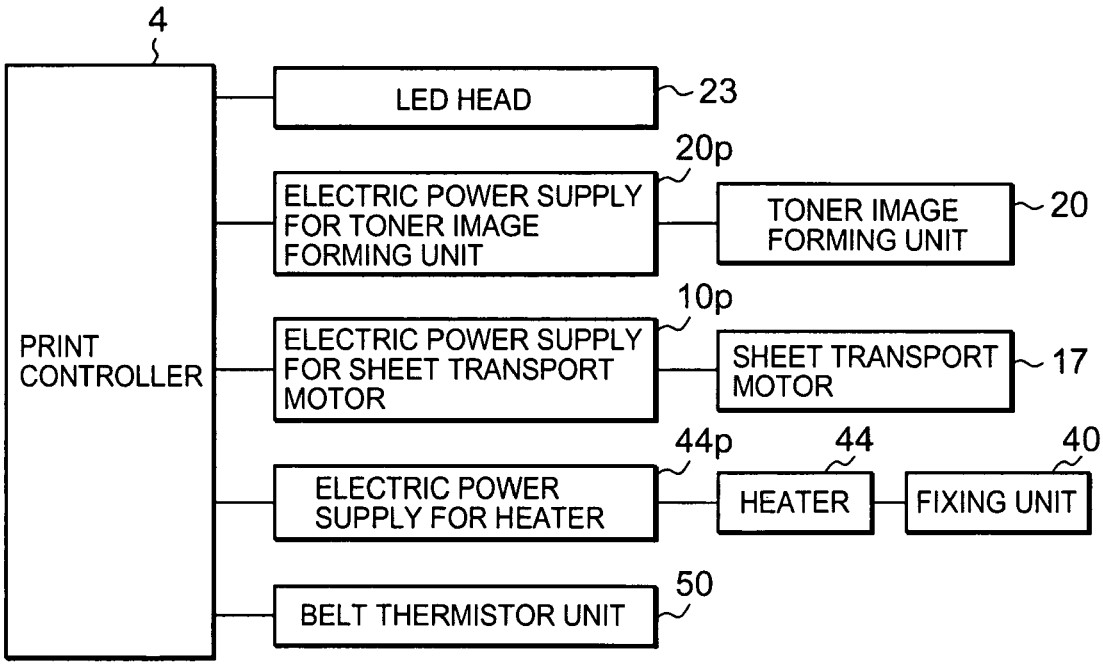
FIG. 6 is a block diagram of a control system of the printer of the first embodiment.

Next, a control system of the printer 1 will be described with reference to FIG. 6. FIG. 6 is a block diagram of the control system of the printer 1.

Referring to FIG. 6, the print controller 4 may include a microprocessor, a memory, an input/output (I/O) port and a timer, not shown. The print controller 4 is interconnected to the LED head 23, an electric power supply 20*p*, an electric power supply 10*p*, the electric power supply 44*p* and the belt thermistor unit 50 so as to control a series of printing processes executed on the image data. As described above, the LED head 23 exposes the surface of the photosensitive drum 21 in accordance with the image data to form the electrostatic latent image thereon. The electric power supply 20*p* is connected to the toner image forming unit 20 and supplies each element of the toner image forming unit 20 with electric power. The electric power supply 10*p* supplies a sheet transport motor 17, which drives each element of the sheet transport unit 10, with electric power. The electric power supply 44*p* is connected to the heater 44 that heats the fixing belt 43, and supplies the heater 44 with electric power. As described above, the belt thermistor unit 50 detects the temperature of the fixing belt 43.

Next, a heating control operation of the fixing unit 40 during printing will be described with reference to FIGS. 2 to 6.

The heater 44 receives electric power from the electric power supply 44*p* and heats a contact portion of the fixing belt 43 that is in contact with the heater 44. The heated contact portion storing heat moves toward the upper pressure roller 41 as the fixing belt 43 rotates in the clockwise direction in conjunction with the rotation of the upper pressure roller 41. When the heated contact portion reaches the nip portion 41*c*, part of heat stored in the heated contact portion is transferred to the upper pressure roller 41 and the recording medium 3. Subsequently, the heated contact portion of the fixing belt 43 moves into contact with the belt support member 60. When the heated contact portion comes into contact with the belt support member 60, some of the heat stored in the heated contact portion is transferred to the belt support member 60. At this time, due to low heat capacity and low thermal resistance of belt support member 60, the temperature of the belt support member 60 becomes almost the same temperature as the fixing belt 43.

The thermistor 53 of the belt thermistor unit 50, which is incorporated in the belt support member 60, detects the temperature of the fixing belt 43 through the fixed member 51 and the contact member 65. Actually, the print controller 4 calculates the temperature of the fixing belt 43 based on the resistance of the thermistor 53. During continued rotation of the upper pressure roller 41 in the clockwise direction, the fixing belt 43 continues to rotate while transferring heat to the upper pressure roller 41, the recording medium 3 and the belt support member 60. The fixing unit 40 fixes the toner image onto the recording medium 3 with heat from the fixing belt 43 heated by the heater 44 and pressure from the lower pressure roller 42.

As described above, the widths of the contact member 65 and the belt support member 60 are greater than or equal to the width of the fixing belt 43. Therefore, the contact member 65 and the belt support member 60 come into uniform contact with the inner surface of the fixing belt 43 throughout the entire area in the width direction of the fixing belt 43. In addition, the contact pressure between the fixing belt 43 and the contact member 65 is uniform within the area where the fixing belt 43 is in contact with the contact member 65. Similarly, the contact pressure between the fixing belt 43 and the belt support member 60 is uniform within the area where the fixing belt 43 is in contact with the belt support member 60. Therefore, even if the fixing belt 43 wears by friction between the fixing belt 43 and the contact member 65 or by friction between the fixing belt 43 and the belt support member 60, the depth of wear becomes uniform in the width direction of the fixing belt 43. This can prevent temperature variations of the fixing belt 43 in the width direction thereof.

Figure 7:
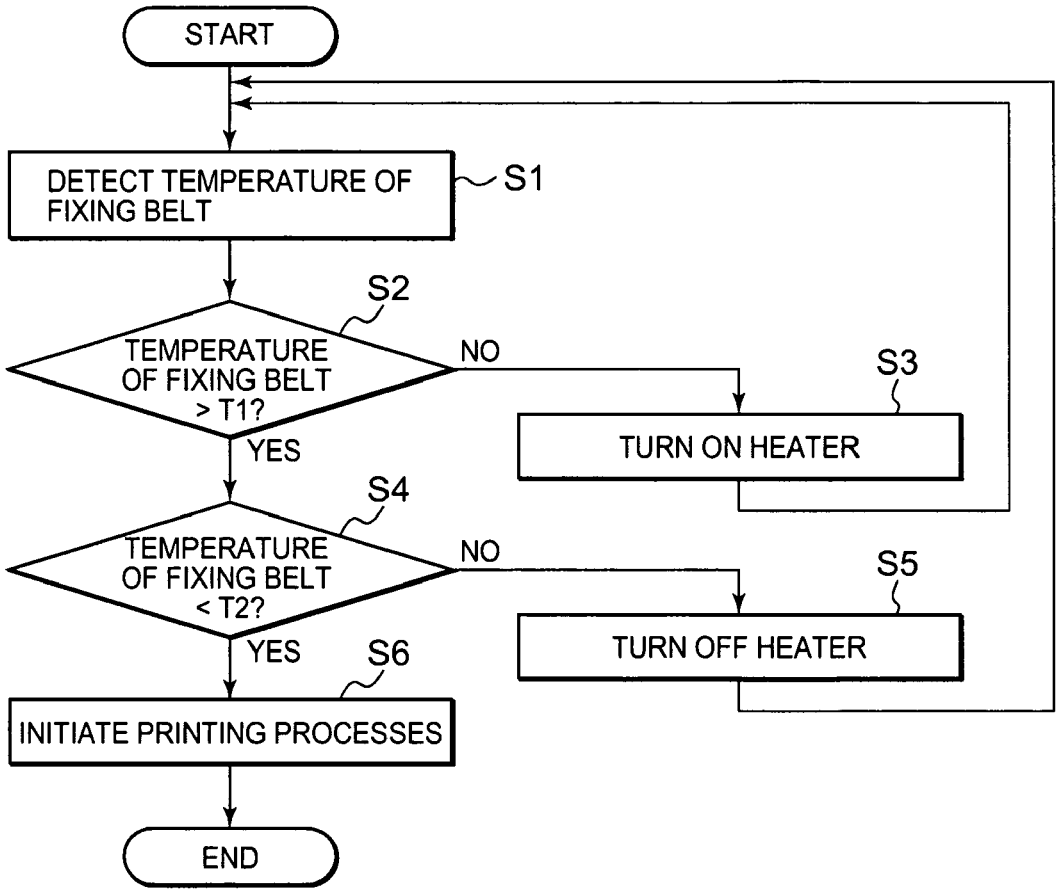
FIG. 7 is a flow chart of a fixing temperature control operation of the fixing unit during printing, according to the first embodiment.

Next, a fixing temperature control operation of the fixing unit 40 during printing will be described. FIG. 7 is a flow chart of the fixing temperature control operation of the fixing unit 40 during printing.

The print controller 4 drives the upper pressure roller 41 upon receiving a command to perform printing processes from an external device. The print controller 4 calculates the temperature of the fixing belt 43 based on the resistance of the thermistor 53 of the belt thermistor unit 50. Then, the print controller 4 determines whether or not the temperature of the fixing belt 43 is within a fixing temperature range. If the temperature of the fixing belt 43 is not within the fixing temperature range, the print controller 4 controls the heater 44 so that the temperature of the fixing belt 43 falls within the range. Specifically, if the temperature of the fixing belt 43 is not within the fixing temperature range, the print controller 4 turns on or turns off the heater 44. On the other hand, if the temperature of the fixing belt 43 is within the fixing temperature range, the print controller initiates the printing processes. Note that the fixing temperature range is defined as a temperature range in which the toner image transferred to the recording medium 3 can be properly fused on the recording medium 3. For example, a temperature of the lower limit T1 and a temperature of the upper limit T2 of the fixing temperature range are respectively 150° C. and 170° C.

The fixing temperature control operation of the fixing unit 40 will be described in more detail with reference to FIG. 7. The fixing temperature control operation of the fixing unit 40 is started upon receiving a command to perform printing processes.

At S1, the print controller 4 detects the temperature of the fixing belt 43 by using the thermistor 53 of the belt thermistor unit 50 incorporated in the belt support member 60.

At S2, the print controller 4 compares the temperature of the fixing belt 43 detected at S1 with the temperature of the lower limit T1. If the temperature of the fixing belt 43 is higher than the temperature of the lower limit T1, the process proceeds to S4. On the other hand, if the temperature of the fixing belt 43 is lower than or equal to the temperature of the lower limit T1, the process proceeds to S3.

At S3, the print controller 4 commands the electric power supply 44*p* to supply the heater 44 with electric power. In other words, the print controller 4 commands the electric power supply 44*p* to turn on the heater 44.

At S4, the print controller 4 compares the temperature of the fixing belt 43 detected at S1 with the temperature of the upper limit T2. If the temperature of the fixing belt 43 is lower than the temperature of the upper limit T2, the process proceeds to S6. On the other hand, if the temperature of the fixing belt 43 is higher than or equal to the temperature of the upper limit T2, the process proceeds to S5.

At S5, the print controller 4 commands the electric power supply 44*p* to cut the supply of electric power to the heater 44. In other words, the print controller 4 commands the electric power supply 44*p* to turn off the heater 44.

At S6, the print controller 4 initiates the printing processes.

The fixing temperature control operation of the fixing unit 40 ends when the printing processes are completed.

As described above, in the first embodiment, the contact member 65 and the belt support member 60 come into uniform contact with the inner surface of the fixing belt 43 throughout the entire area in the width direction of the fixing belt 43. In addition, the contact pressure between the fixing belt 43 and the contact member 65 is uniform within the area where the fixing belt 43 is in contact with the contact member 65. Similarly, the contact pressure between the fixing belt 43 and the belt support member 60 is uniform within the area where the fixing belt 43 is in contact with the belt support member 60. Therefore, even if the fixing belt 43 wears by friction between the fixing belt 43 and the contact member 65 or by friction between the fixing belt 43 and the belt support member 60, the depth of wear becomes uniform in the width direction of the fixing belt 43. Thus, the fixing unit 40 is capable of preventing scratches on a surface of the fixing belt 43, and is capable of preventing temperature variations of the fixing belt 43 even when the fixing belt 43 wears, thereby improving print quality.

Second Embodiment

A fixing unit 240 of a second embodiment differs from the fixing unit 40 of the first embodiment in that a noncontact belt thermistor unit 80 and a belt support member 90 are used in place of the belt thermistor unit 50 and the belt support member 60. The other elements are the same as those in the first embodiment. Therefore, elements similar to those in the first embodiment have been given the same numerals and their description is omitted.

Figure 8:
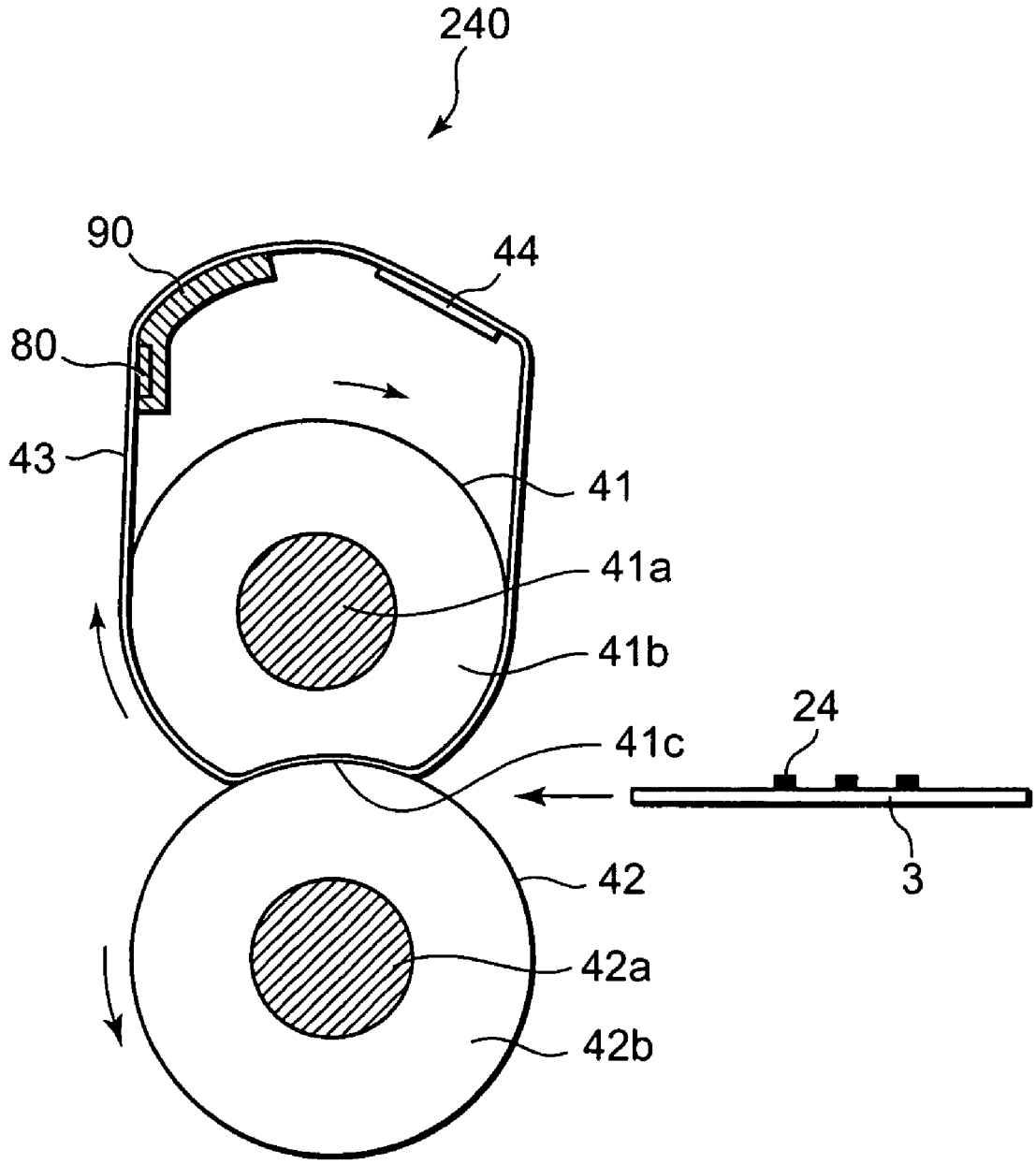
FIG. 8 is sectional side view of a fixing unit of a second embodiment.
Figure 9:
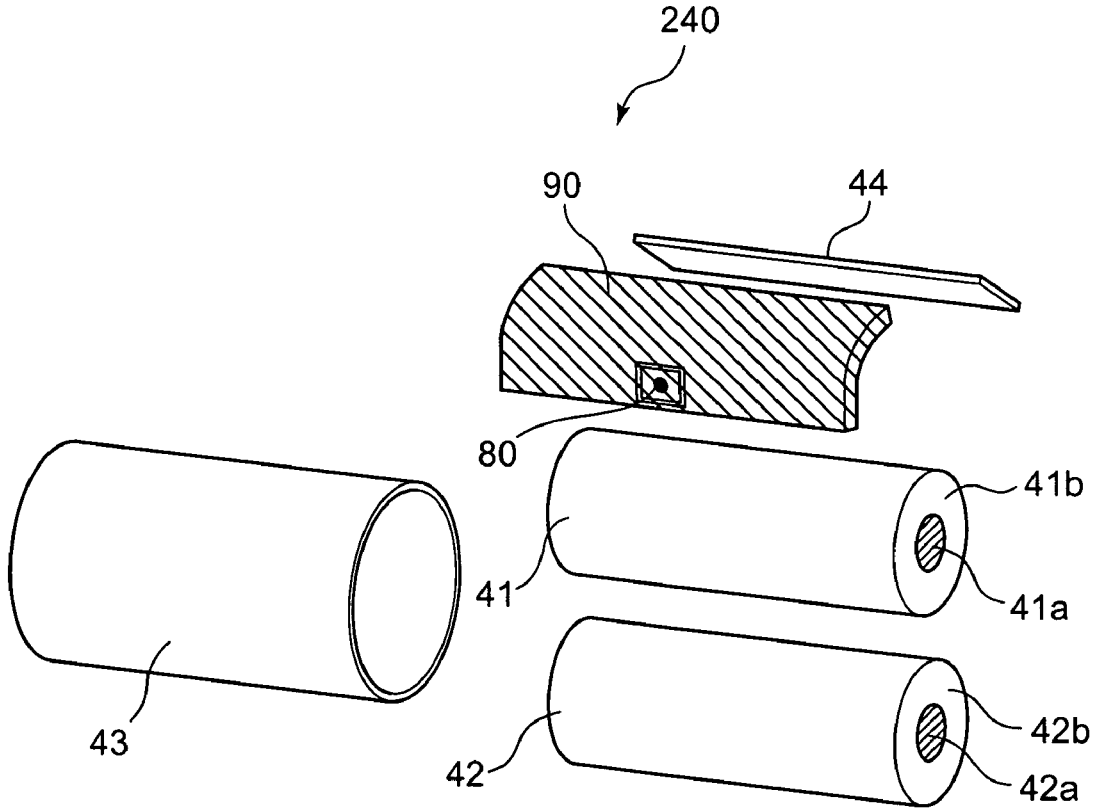
FIG. 9 is an exploded perspective view of the fixing unit of the second embodiment.
Figure 10:
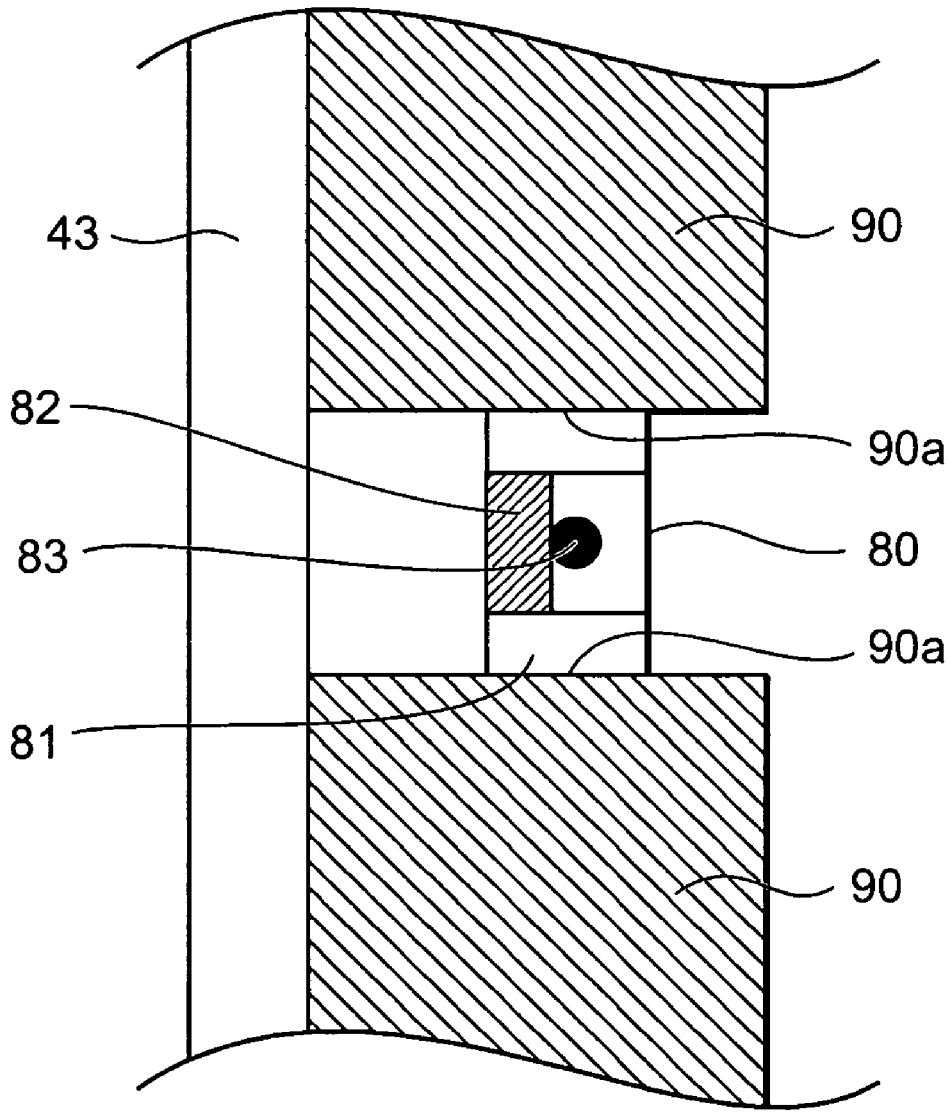
FIG. 10 is a partially enlarged view of the vicinity of a noncontact belt thermistor unit of the second embodiment.
Figure 11:
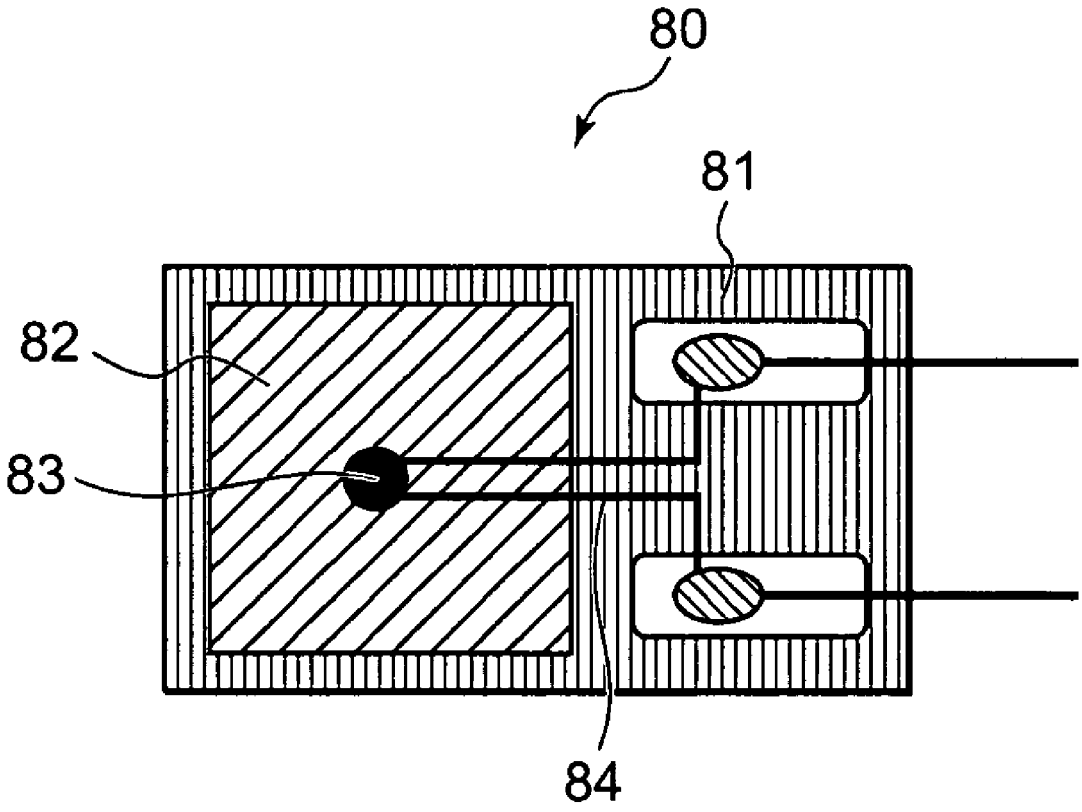
FIG. 11 is a schematic view of the noncontact belt thermistor unit of the second embodiment.

FIGS. 8 and 9 are respectively a sectional side view and an exploded perspective view of the fixing unit 240. FIG. 10 is a partially enlarged view of the vicinity of the noncontact belt thermistor unit 80. FIG. 11 is a schematic view of the noncontact belt thermistor unit 80.

The fixing unit 240 fixes the toner image transferred to the recording medium 3 by the transfer unit 30, onto the recording medium 3 with heat and pressure. Referring to FIG. 8, the fixing unit 240 includes the noncontact belt thermistor unit 80 and the belt support member 90 in addition to the upper pressure roller 41, the lower pressure roller 42, the fixing belt 43 and the heater 44 of the first embodiment. The noncontact belt thermistor unit 80 and the belt support member 90 will be described below in more detail.

The noncontact belt thermistor unit 80 is incorporated in the belt support member 90 to detect the temperature of the fixing belt 43 without making contact therewith. Referring to FIG. 11, the noncontact belt thermistor unit 80 may include a thermistor 83, a thermistor frame 81, a thermal film 82 and thermistor wires 84.

As shown in FIG. 10, the thermistor frame 81 is adhesively secured to ends 90*a* of a hollow, or a recess, of the belt support member 90 and supports the thermal film 82, the thermistor 83 and the thermistor wires 84. The thermistor frame 81 may be substantially rectangular and may be made of resin that has high heat-resistance. The thermal film 82 converts infrared radiation, which is emitted by the fixing belt 43 in accordance with the temperature thereof, into heat. The thermal film 82 may be substantially rectangular and may be made of polyimide resin that has high heat-resistance. The thermal film 82 is adhesively secured to the thermistor frame 81. The thermistor 83, or other temperature detector, is similar to the thermistor 53 of the first embodiment. That is, resistance thereof varies depending on the temperature of the fixing belt 43. The thermistor 83 is adhesively secured to the thermal film 82. The thermistor wires 84 are similar to the thermistor wires 54 of the first embodiment. That is, the thermistor wires 84 connect the thermistor 83 and the print controller 4. One end of each of the thermistor wires 84 is connected to the thermistor 83 and the other end of each of them is connected to the print controller 4. The print controller 4 acquires the resistance of the thermistor 83 through the thermistor wires 84.

Similarly to the belt support member 60 of the first embodiment, the belt support member 90 may be made of polyphenylene sulfide (PPS) that has high heat-resistance. Part of the belt support member 90 is rounded so as not to interfere with rotation of the fixing belt 43. The width of the belt support member 90 is greater than or equal to the width of the fixing belt 43. Therefore, the belt support member 90 comes into uniform contact with the inner surface of the fixing belt 43 throughout the entire area in the width direction of the fixing belt 43. Note that the belt support member 90 immovably supports the noncontact belt thermistor unit 80 between the ends 90*a* of the hollow of the belt support member 90.

Next, a temperature detection operation of the noncontact belt thermistor unit 80 during printing will be described with reference to FIGS. 8 to 10. Referring to FIG. 8, the heater 44 heats a contact portion of the fixing belt 43 that is in contact with the heater 44. The heated contact portion storing heat moves toward the upper pressure roller 41 as the fixing belt 43 rotates in the clockwise direction in conjunction with the rotation of the upper pressure roller 41. When the heated contact portion reaches the nip portion 41*c*, a portion of heat stored in the heated contact portion is transferred to the upper pressure roller 41 and the recording medium 3. Subsequently, the heated contact portion of the fixing belt 43 moves into contact with the belt support member 90. When the heated contact portion comes into contact with the belt support member 90, a portion of heat stored in the heated contact portion is transferred to the belt support member 90. During continued rotation of the upper pressure roller 41 in the clockwise direction, the fixing belt 43 continues to rotate while transferring heat to the upper pressure roller 41, the recording medium 3 and the belt support member 90. The thermistor 83 of the noncontact belt thermistor unit 80 detects the temperature of the fixing belt 43 at a predetermined distance from the fixing belt 43 and through the thermal film 82. Specifically, the print controller 4 calculates the temperature of the fixing belt 43 based on the resistance of the thermistor 83, thereby detecting the temperature of the fixing belt 43.

As described above, the width of the belt support member 90 is greater than or equal to the width of the fixing belt 43.

Therefore, the belt support member 90 comes into uniform contact with the inner surface of the fixing belt 43 throughout the entire area in the width direction of the fixing belt 43. In addition, the contact pressure between the fixing belt 43 and the belt support member 90 is uniform within the area where the fixing belt 43 is in contact with the belt support member 90. Therefore, even if the fixing belt 43 wears by friction between the fixing belt 43 and the belt support member 90, the depth of wear becomes uniform in the width direction of the fixing belt 43. This can prevent temperature variations of the fixing belt 43 in the width direction thereof.

As described above, in the second embodiment, the noncontact belt thermistor unit 80 detects the temperature of the fixing belt 43 without making contact therewith. Therefore, in addition to having the same above-described advantageous effects as the first embodiment, the second embodiment also makes it possible to reduce wear of the fixing belt 43, thereby further improving print quality. Furthermore, since there is no object between the noncontact belt thermistor unit 80 and the fixing belt 43, the noncontact belt thermistor unit 80 is able to respond fast to a change in temperature of the fixing belt 43.

Third Embodiment

A fixing unit 340 of a third embodiment has a thermal film 102 on which a thermistor 103 is disposed, directly joined to a belt support member 110. The other elements are the same as those in the first and second embodiments. Therefore, elements similar to those in the first and second embodiments have been given the same numerals and their description is omitted.

Figure 12:
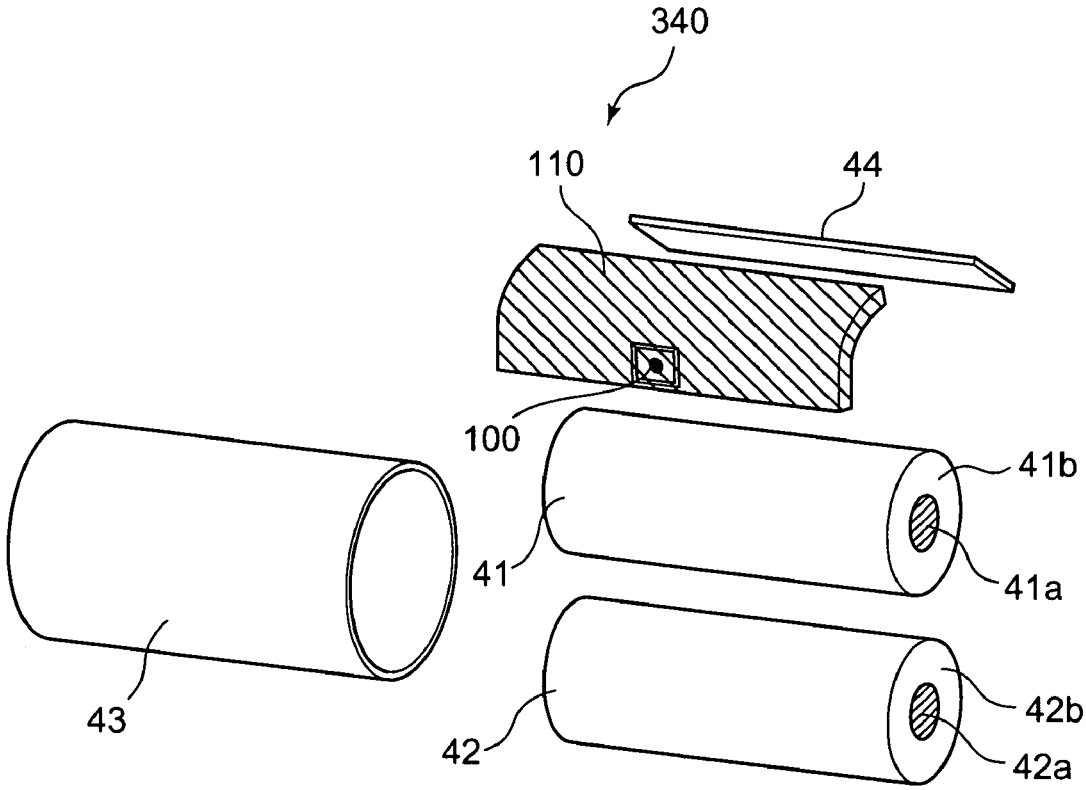
FIG. 12 is an exploded perspective view of a fixing unit of a third embodiment.
Figure 13:
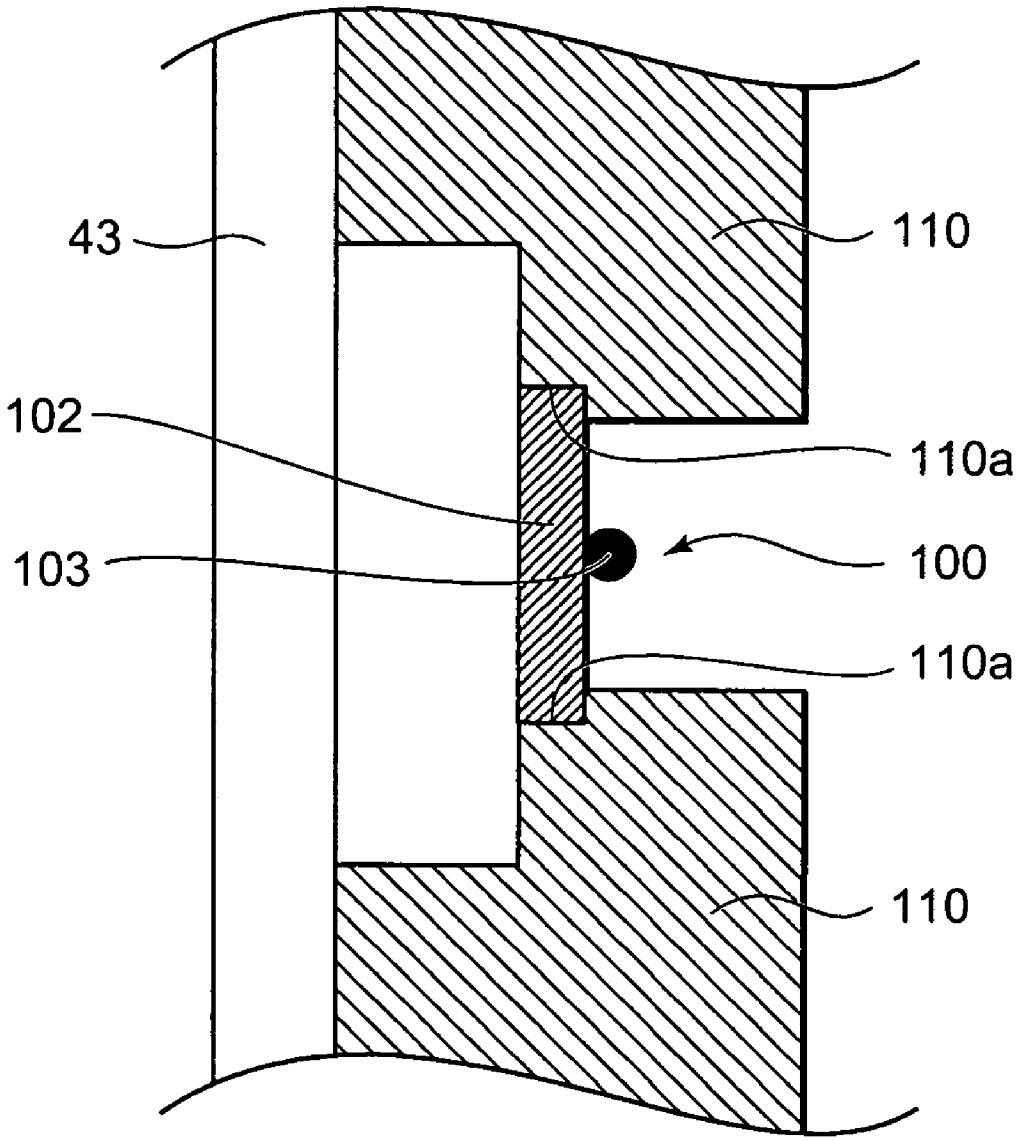
FIG. 13 is a partially enlarged view of the vicinity of a noncontact belt thermistor unit of the third embodiment.

FIG. 12 is an exploded perspective view of the fixing unit 340. FIG. 13 is a partially enlarged view of the vicinity of a noncontact belt thermistor unit 100.

The fixing unit 340 fixes the toner image transferred to the recording medium 3 by the transfer unit 30, onto the recording medium 3 with heat and pressure. Referring to FIG. 12, the fixing unit 340 includes the noncontact belt thermistor unit 100 and the belt support member 110 in addition to the upper pressure roller 41, the lower pressure roller 42, the fixing belt 43 and the heater 44 of the first and second embodiments. The noncontact belt thermistor unit 100 and the belt support member 110 will be described below in more detail.

The noncontact belt thermistor unit 100 is incorporated in the belt support member 110 to detect the temperature of the fixing belt 43 without making contact therewith. Referring to FIG. 13, the noncontact belt thermistor unit 100 may include a thermistor 103, a thermal film 102 and thermistor wires not shown. As shown in FIG. 13, both ends of the thermal film 102 of the noncontact belt thermistor unit 100 are adhesively secured to ends 110*a* in a hollow, or a recess, of the belt support member 110, and the thermistor 103 is disposed on the thermal film 102 without making contact with the fixing belt 43. The thermal film 102 converts infrared radiation, which is emitted by the fixing belt 43 in accordance with the temperature thereof, into heat. The thermal film 102 may be substantially rectangular and may be made of polyimide resin that has high heat-resistance.

Similarly to the belt support member 60 and 90 of the first and second embodiment, the belt support member 110 may be made of polyphenylene sulfide (PPS) that has high heat-resistance. Part of the belt support member 110 is rounded so as not to interfere with rotation of the fixing belt 43. The width of the belt support member 110 is greater than or equal to the width of the fixing belt 43. Therefore, the belt support member 110 comes into uniform contact with the inner surface of the fixing belt 43 throughout the entire area in the width direction of the fixing belt 43. Note that the belt support member 110 immovably directly supports the thermal film 102 between the ends 110*a* of the hollow of the belt support member 110.

As described above, in the third embodiment, the thermal film 102 on which a thermistor 103 is disposed is directly joined to a belt support member 110. Therefore, in addition to having the same above-described advantageous effects as the first and second embodiments, the third embodiment also makes it possible to reduce the number of components of the fixing unit 340, thereby reducing production costs and shortening production lead time of the printer 1.

While each embodiment has been described with respect to an electrophotographic monochrome printer as an image forming apparatus, the invention may be applicable to any other image forming apparatus, such as a color printer, a copier, a facsimile machine or a multifunction peripheral (MFP). In addition, although each embodiment has been described about the case where the toner cartridge 25 is detachably mountable to the toner image forming unit 20, the toner cartridge 25 may be integrated in the toner image forming unit 20. Moreover, in the case of a color printer, four toner image forming units 20K, 20Y, 20M and 20C, which respectively forms a black toner image, a yellow toner image, a magenta toner image and a cyan toner image, may be arranged in the printer. Instead, three toner image forming units 20Y, 20M and 20C corresponding to three colors other than black may be arranged in the printer. Furthermore, in the case of a monochrome printer, multiple toner image forming units 20K for forming black toner images may be arranged in the printer.

As just described, the number of toner image forming units 20, combinations of colors of the toner image forming units 20 and positions of the toner image forming units 20 are not limited. Note that, in the image forming apparatus that has multiple toner image forming units 20, a transfer belt for transporting the recording medium 3 may be disposed below the toner image forming units 20.

The fixing device and the image forming apparatus being thus described, it will be apparent that the same may be varied in many ways. Such variations are not to be regarded as a departure from the sprit and scope of the invention, and all such modifications as would be apparent to one of ordinary skill in the art are intended to be included within the scope of the following claims.

What is claimed is:

1. A fixing device comprising:

a heater;

a first pressure-applying member;

a belt support member;

a fixing belt that is entrained about the heater, the first pressure-applying member and the belt support member;

a second pressure-applying member that opposes the first pressure-applying member through the fixing belt;

a contact member that is in contact with an inner surface of the fixing belt and extends in the width direction of the fixing belt, the contact member having a length along said width direction of the fixing belt that is greater than or equal to a length of the fixing belt; and a temperature detector that detects a temperature of the fixing belt through the contact member and is disposed between the belt support member and the contact member.

2. The fixing device according to claim 1, wherein the temperature detector is a thermistor.

3. The fixing device according to claim 1, wherein the contact member is made of a heat-resistant material.

4. The fixing device according to claim 1, wherein the contact member is made of polyimide resin.

5. The fixing device according to claim 1, wherein the belt support member includes a flat portion and a curved portion, the temperature detector being disposed on the flat portion.

6. An image forming apparatus comprising:

a transport unit that transports a recording medium;

an image forming unit that forms a toner image on a surface of the recording medium; and the fixing device according to claim 1 that fixes the toner image formed by the image forming unit onto the recording medium.

7. A fixing device comprising:

a heater;

a first pressure-applying member;

a belt support member;

a fixing belt that is entrained about the heater, the first pressure-applying member and the belt support member;

a second pressure-applying member that opposes the first pressure-applying member through the fixing belt; and a temperature detector that detects a temperature of the fixing belt;

wherein the belt support member includes a recess on a surface coming into contact with the fixing belt, the temperature detector is disposed in the recess without making contact with the fixing belt such that a predetermined void is disposed between the temperature detector and the fixing belt.

8. The fixing device according to claim 7, wherein the temperature detector is a thermistor.

9. The fixing device according to claim 7, further comprising a thermal film that supports the temperature detector.

10. An image forming apparatus comprising:

a transport unit that transports a recording medium;

an image forming unit that forms a toner image on a surface of the recording medium; and the fixing device according to claim 7 that fixes the toner image formed by the image forming unit onto the recording medium.

* * * * *